United States Patent [19]

Corbett et al.

[11] Patent Number: 4,911,623

[45] Date of Patent: Mar. 27, 1990

[54] METHOD AND APPARATUS FOR LUBRICATING A ROTARY ENGINE

[75] Inventors: William D. Corbett; Benjamin L. Sheaffer, both of Fond du Lac, Wis.

[73] Assignee: Brunswick Corporation, Skokie, Ill.

[21] Appl. No.: 344,822

[22] Filed: Apr. 28, 1989

[51] Int. Cl.[4] ..... F01C 21/04

[52] U.S. Cl. ..... 418/88; 418/91; 418/98

[58] Field of Search ..... 418/88, 83, 91, 98, 418/100, 86

[56] References Cited

U.S. PATENT DOCUMENTS

| | | | |
|---|---|---|---|
| 2,975,964 | 3/1961 | Osterkamp | 418/88 |
| 3,168,237 | 2/1965 | Pasche | 418/91 |
| 3,360,192 | 12/1967 | Van Hees | 418/88 |
| 3,804,560 | 4/1974 | Bensinger | 418/91 |
| 3,988,080 | 10/1976 | Takada | 418/98 |
| 4,011,032 | 3/1977 | Steinwart et al. | 418/91 |
| 4,345,885 | 8/1982 | Turner | 418/91 |
| 4,844,702 | 7/1989 | Ceccherini et al. | 418/88 |

*Primary Examiner*—Willis R. Wolfe
*Assistant Examiner*—M. Macy
*Attorney, Agent, or Firm*—Andrus, Sceales, Starke & Sawall

[57] ABSTRACT

A lubricating system for a rotary internal combustion engine includes an oil supply chamber at one end of the rotorshaft to which lubricating oil is supplied by an engine driven oil pump. The oil is caused to flow from the chamber along the rotorshaft and into the interfaces between the various rotating engine components attached to the rotorshaft. In the preferred orientation of the engine with the rotorshaft vertically disposed, oil flow is primarily under the influence of gravity. Oil accumulating in a sump at the lower end of the rotorshaft is circulated to the combustion region of the rotor chamber, utilizing the inherent pressure differential therebetween, where it provides further engine lubrication and is eventually burned. Lubricating oil may also be picked up and circulated from the main supply dispersed along the rotorshaft by the circulating supply of cooling air through the engine, whereby it is transferred in the combustion air supplied to the carburetor.

10 Claims, 2 Drawing Sheets

METHOD AND APPARATUS FOR LUBRICATING A ROTARY ENGINE

BACKGROUND OF THE INVENTION

The present invention relates to a lubrication system and its method of operation for use in a rotary engine and, in particular, to an assembly useful in a rotary engine adapted for marine applications.

The rotary internal combustion engine has gained significant acceptance and is being used more widely in automotive applications. One of the major attractions of the rotary engine is the relative simplicity of its construction as compared to more conventional reciprocating piston engines. In addition, advances in engineering technology have eliminated or substantially alleviated certain design and operational problems previously associated with rotary piston engines, such as rotor seal efficiency and life. As a result, additional applications for rotary engines are being evaluated. One particularly attractive application for the rotary engine is marine use and, in particular, in outboard boat motors.

In adapting a rotary engine to an outboard motor, the engine crankshaft or rotorshaft is preferably disposed vertically, as is the crankshaft in a conventional reciprocating piston engine. Similarly as with conventional engines, flywheel is attached to the upper end of the rotorshaft and the lower end of the rotorshaft is attached to a driveshaft which, in turn, extends down into connection with a lower gear case for driving the propeller. As with any other internal combustion engine where a flow of intake air is induced by operation of the engine, the intake of combustion air in a rotary engine may also be induced by engine rotation. The housing of a rotary engine may also often be air cooled or may include a combination of air and water cooling. If air cooling is utilized, cooling air flow is also induced by engine rotation. For the sake of convenience and simplicity of engine construction, a single flow of air is often utilized both for internal cooling of the rotor and for combustion. Thus, after a flow of air is directed through the interior of the engine rotor for cooling, it is directed into the carburetor, mixed with the fuel and passed into the combustion region of the rotor chamber.

In a typical prior art rotary engine construction in which the rotorshaft is horizontally disposed, lubricating oil may be added at opposite ends of the rotorshaft where it is journaled in the ends of the engine block. In addition, lubricating oil may also be mixed with the fuel and introduced therewith into the rotor chamber. The oil in the fuel provides lubrication for the rotor seals, and is then burned with the fuel in the combustion process. In effect, two separate lubrication systems are required, one for supplying oil directly to the main rotorshaft bearings, and another supplying oil mixed with fuel to the rotor chamber. Even in rotary engines which have oil-cooled rotors, oil is additionally intentionally mixed with the fuel to lubricate the rotor seals.

It would be desirable, therefore, to have a single lubricating system requiring only one source of lubricating oil to provide total engine lubrication.

SUMMARY OF THE INVENTION

In accordance with the present invention, lubricating oil is supplied from a reservoir to one end of the rotorshaft in a rotary engine and caused to flow axially along the rotorshaft under the influence of gravity and/or the induced flow of cooling air through the engine. With a rotary engine particularly adapted for marine use in an outboard motor, the rotorshaft is vertically disposed and the lubricating oil flowing downwardly along the rotorshaft from the upper end effectively and efficiently provides lubrication to the various bearings and gears operatively attached to the rotorshaft. The lower end of the rotorshaft extends through a sump where lubricating oil is collected and circulated into the engine combustion chamber. A portion of the lubricating oil may also be picked up by the induced flow of cooling air through the engine, which air is typically directed to the carburetor or engine fuel inlet to be mixed with the fuel for combustion. The oil entrained in the combustion air flow enters the rotor housing and lubricates the moving parts therein. Oil collected in the sump may also be drawn by the induced low pressure at the rotor housing air/fuel intake into the engine rotor housing. The downwardly flow of oil under the influence of gravity also provides positive lubrication for the oil pump drive mechanism operatively attached to the lower end of the rotorshaft.

In a single rotor engine having a vertically disposed rotorshaft, the flow of cooling and combustion air may be caused to move in the same direction as the gravity low of oil, thereby assisting the oil flow. Thus, the cooling combustion air may be caused to enter near the upper end of the engine block, to flow axially downwardly along the rotorshaft through the rotor and to exit near the lower end of the block. Because the cooling combustion air is typically circulated directly to the carburetor to mix with the fuel, oil entrained in the air will be injected directly into the engine for combustion.

Cooling air flow through the engine may provide the primary means for causing the lubricating oil to flow axially along the rotorshaft, particularly in applications where the rotorshaft is horizontally disposed. In a twin rotor engine, where separate flows of cooling air are typically provided in axially opposite directions, lubricating oil may be supplied directly to both outer ends of the rotorshaft and caused to flow axially toward the center of the engine block with the induced flow of cooling air. The cooling air and entrained oil leaves the engine block at center thereof and is directed therefrom to the combustion regions of the two rotor chambers.

DETAILED DESCRIPTION OF THE PREFERRED EMBODIMENT

Figure 1:
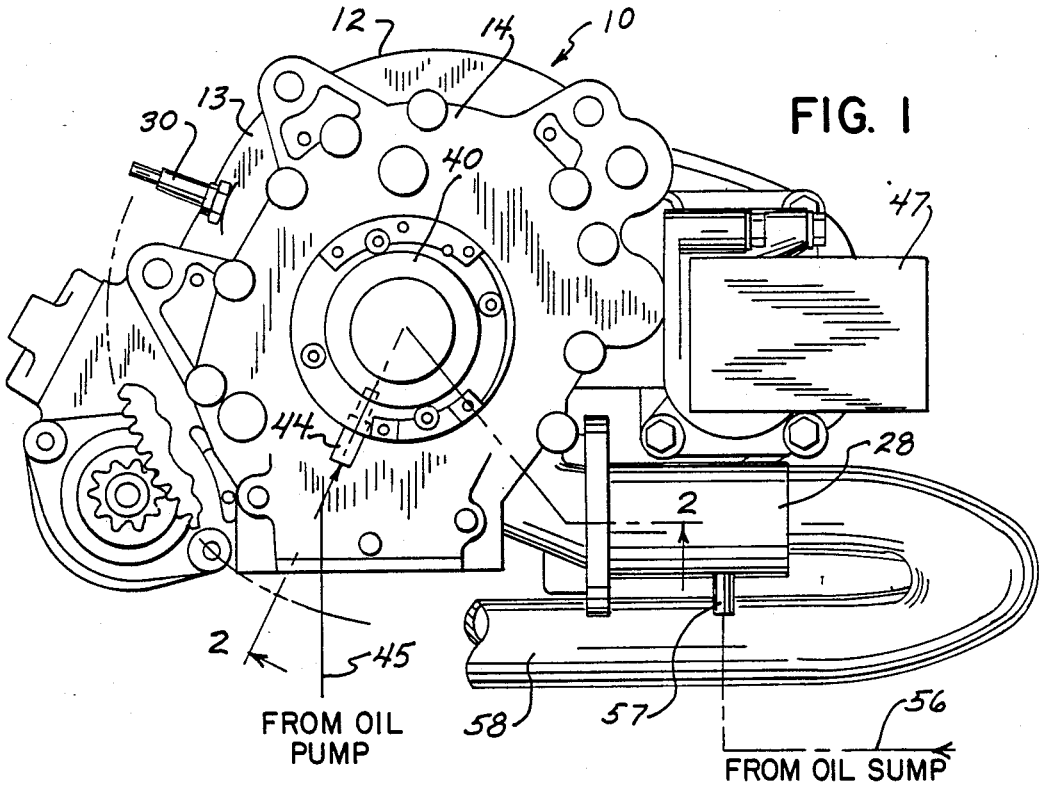
FIG. 1 is a top plan view of a rotary engine utilizing the lubricating apparatus of the present invention.
Figure 2:
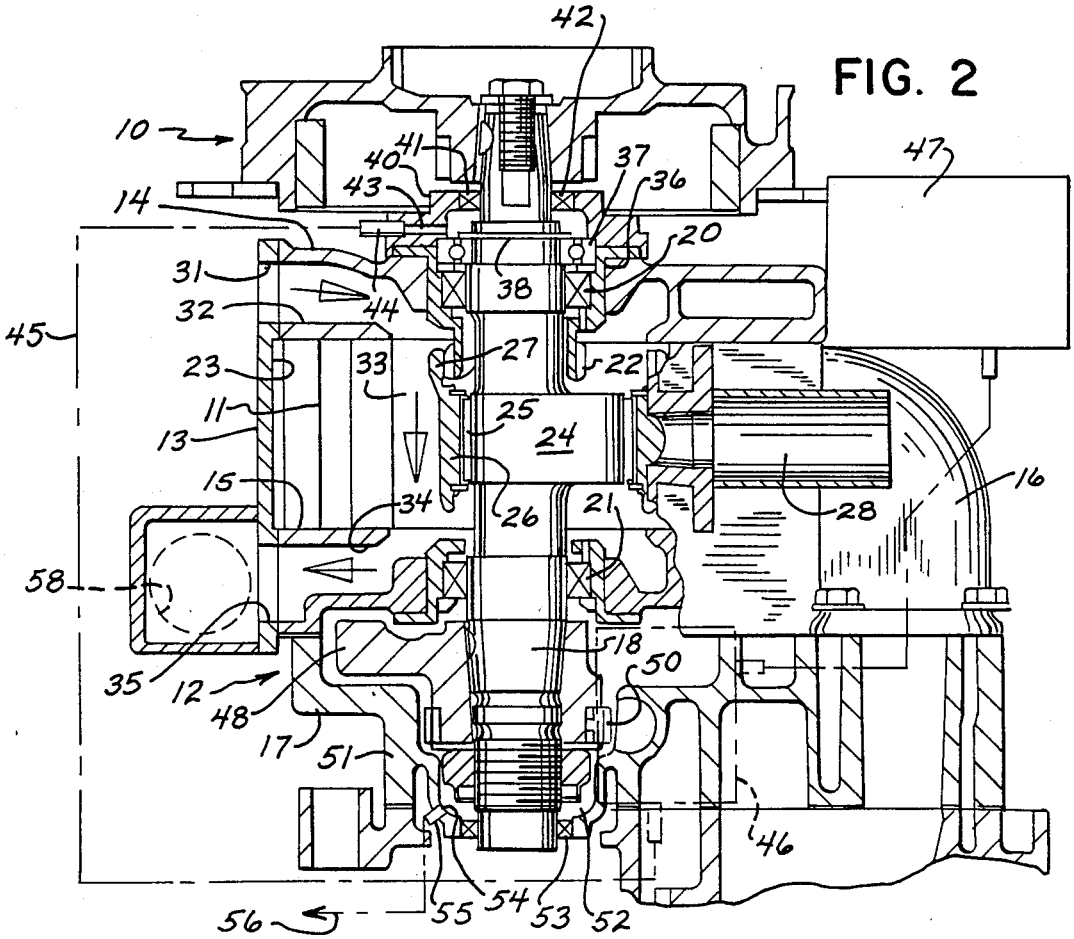
FIG. 2 is a vertical section through the engine taken on line 2—2 of FIG. 1.

Referring to FIGS. 1 and 2, a rotary engine 10 of the type utilizing a single rotor 11 is adapted particularly for use in an outboard boat motor. The engine block 12 comprises an intermediate rotor housing 13, an upper housing 14, and a lower housing 15. The upper and lower housings 14 and 15 are attached to opposite faces of the rotor housing 13. Each of the housing members preferably comprises an aluminum or aluminum alloy casting for corrosion resistance and light weight. Some or all of the castings may be made in two pieces.

An exhaust manifold 16 is attached to the outside of the engine block 12 and extends downwardly from the rotor housing 13 to the bottom of the lower housing 15. When utilized in an outboard motor construction, the exhaust manifold 16 and lower housing 15 are attached to a lower adaptor plate 17 which provides a transition region for engine exhaust discharge and cooling water supply, as well as an enclosure for the lower portion of the engine.

Each of the housing members 13–15 comprising the engine block is provided with a generally centrally located opening to accommodate the assembly of the rotor 11 and a motorshaft 18. The rotorshaft extends vertically through the engine block and is journaled for rotation therein on upper and lower bearings 20 and 21, respectively, mounted in the central openings in the upper and lower housings 14 and 15. A stationary gear 22 is attached to the upper housing 14 concentrically with the upper bearing 20 and with the axis of rotation of the rotorshaft 18.

The rotor housing 13 includes an enlarged central opening which defines a rotor chamber 23 having a characteristic epitrochoidal configuration which is conventional in rotory engine construction. The rotorshaft 18 extend vertically through the engine block and includes an enlarged cylindrical eccentric portion 24 disposed within the rotor chamber 23. The rotor 11 is rotatably mounted on the cylindrical eccentric 24 by a needle bearing assembly 25 carried on a cylindrical sleeve 26 attached to the inner cylindrical surface of the rotor 11. The cylindrical sleeve 26 includes an integral upwardly extending rotor gear 27 adapted to engage the downwardly extending stationary gear 22. The diameter of the rotor gear 27 is substantially larger than the diameter of the stationary gear 22, thereby providing the eccentric rotary movement of the rotor 11 within the rotor chamber 23 in a manner conventional to the operation of a rotary engine.

A rotary engine may also be constructed with twin rotors, each operating in a separate rotor housing. In addition to obvious differences including a lengthened rotorshaft and exhaust manifold, a twin rotor engine also requires a center housing member between the two rotor housings, as will be described hereinafter. With either a twin rotor engine or a single rotor engine, as shown, adaptation of the engine to an outboard motor requires attachment of the lower end of the rotorshaft to the upper end of an outboard motor driveshaft (not shown). The driveshaft extends downwardly into operative connection with a lower gear case and propeller in a conventional manner.

In operation of the engine 10, the rotor 11 turns in its eccentric path within the rotor housing 13 (clockwise in FIG. 1) to provide a conventional 4-stroke working cycle. The rotor has three lobes such that different stages of three separate cycles, displaced by 120° occur simultaneously. In a typical cycle, a mixture of combustion air and fuel is drawn into the rotor chamber 23 through a carburetor 28 attached to the outer wall of the rotor housing 13. The mixture is compressed by a successive decrease in volume between one face of the rotor and the rotor housing to the point of ignition from a spark plug 30. Continuing rotation results in the discharge of exhaust gases through the exhaust manifold 16, completing the 4-stroke cycle. Engine cooling water is supplied via a cooling water jacket surrounding the exhaust manifold 16 from which it is circulated by an engine driven water pump through the engine block via water passages in the rotor housing 13 and upper and lower housings 14 and 15, respectively. The cooling water passages in the housings lie generally in the region of engine ignition and exhaust, i.e. generally the semicircumferential portion of the engine including the ignition and exhaust regions of the rotor housing. Thus, cooling water is preferentially supplied to the areas of the engine block typically experiencing the highest temperature.

Supplemental air cooling is provided for the engine 10 by inducing a flow of outside air through the engine block by rotation of the engine. In general, cooling air is supplied to the region of the engine block not cooled directly by water and including generally the intake and compression areas. Intake air may be brought in via either the upper or the lower housing 14 or 15, passed through the rotor 11 and exhausted via the other housing member 14 or 15. Cooling air from the engine is then used for combustion by directing the air to the carburetor 28 for mixture with engine fuel, in a manner described in commonly-owned, copending application Ser. No. 290,466, filed Dec. 27, 1988, entitled "Tuned Intake Air Inlet for a Rotary Engine, still pending."

In the embodiment shown, cooling combustion air is supplied to the engine through a cooling air inlet 31 in the outer wall of the upper housing 14. From the opening 31, cooling air flows through a cooling air entry passage 32 in the upper housing 14 and into a rotor air passage 33 between the rotor 11 and the rotorshaft 18. From the rotor air passage 33, the cooling air flows through the inner opening in the adjacent lower housing 15 into a cooling air outlet passage 34 therein and out of the housing via a cooling air exit opening 35 in the outer wall of the lower housing 15.

The stationary gear 22 is integrally attached to and extends downwardly from a cylindrical outer race 36 for the upper bearing 20. In the particular embodiment shown, the roller bearing members for the upper bearing 20 are adapted to bear directly on the rotorshaft 18, thereby eliminating the need for an inner race. The cylindrical outer race 36 is mounted in an axial opening in the upper housing 14 concentric with the axis of the rotorshaft. A ball bearing 37 is mounted above the upper bearing 20 between the outer race 36 and the rotorshaft 18. Ball bearing 37 prevents vertical movement of the rotorshaft in the engine block 12 and is held in position on the rotorshaft with a retaining ring 38.

The upper assembly of the ball bearing 37 and upper main bearing 20 is enclosed by an end cap 40. The end cap is provided with an axial opening 41 surrounding the upper end of the rotorshaft and the interface between the end cap and the shaft is sealed with a rotary seal 42. A lubricating oil feed passage 43 is provided through the wall of the end cap 40 and includes an external fitting 44 for attachment of an oil supply line 45. The oil supply line 45 receives lubricating oil from the discharge of a gear driven oil pump 46 operatively attached to the engine near the lower end of the rotorshaft 18. Oil pump 46 may draw lubricating oil directly from an integrally attached reservoir or may receive a supply of oil from a separate reservoir 47 mounted above the pump. The discharge from the oil pump 46 is controlled by engine speed to provide an increased flow of lubricating oil as speed increases.

Lubricating oil supplied to the interior of the end cap 40 via the oil supply line 45 from the pump 46 flows downwardly along the rotorshaft 18 to lubricate all moving parts attached thereto or closely spaced therefrom. Thus, the oil will supply lubrication for the ball bearing 37, main upper bearing 20, the interface between the stationary gear 22 and the rotor gear 27, the rotor/rotorshaft needle bearing assembly 25, and the lower bearing 21. The oil continues axially downwardly along the rotorshaft, past the lower counterweight 48, providing lubrication for the gear assembly 50 for the oil pump 46. An adaptor plate casting 51 is attached to the lower housing 15 and provides an enclosure for the lower end of the rotorshaft. A portion of the adaptor plate 51 defines an oil sump 52 having an axial opening surrounding the lower end of the rotorshaft which opening is sealed with a lower rotary seal 53. When the engine 10 is disposed with the rotorshaft extending vertically, lubricating oil will flow by gravity from the upper end cap 40, along the rotorshaft, with apportion of the oil eventually reaching and collecting in the sump 52. It has been found that the flow of cooling air through the engine, in the direction previously indicated, actually assists in the downward migration of lubricating oil through the engine block. Thus, the flow of cooling air has inward and outward horizontal components as it passes through the cooling air inlet and exit 31 and 34, respectively. The cooling air flow also has a vertical downward component as it flows through the air passage 33 in the rotorchamber 23. The vertical component of air flow is, of course, in the same direction as the gravity flow of oil and helps to move the oil in its downward direction.

The oil accumulating in the oil sump 52 is withdrawn therefrom and directed to the combustion region within the rotor chamber 23 where it provides additional lubrication for the moving parts therein, particularly the rotor seals at the ends of each of the three lobes of the rotor 11. The oil in the combustion region is mixed with the engine fuel and eventually burned. The oil sump 52 includes an oil outlet passage 54 provided with a fitting 55 to which is attached one end of an oil circulation line 56. The opposite end of the oil circulation line 56 is preferably attached to the inlet 57 to the carburetor 28. When the engine is operating, air flow through the engine will create a negative pressure at the carburetor inlet which will cause oil to be withdrawn from the oil sump 52 and directed to the carburetor inlet. There it will be mixed with fuel and combustion air and injected into the combustion region of the rotor chamber 23.

Some amount of lubricating oil will also be entrained in the flow of cooling air passing through the engine, as previously described. Further, the cooling air exiting the engine block through the cooling air outlet 35 in the lower housing 15 is also directed via a combustion air conduit 58 to the carburetor inlet 57 to supply combustion air for the engine. Thus, any oil entrained in the cooling air flow will also be injected into the rotor chamber for lubrication and eventual burning. Because the flow volume of cooling and combustion air varies directly with engine speed, the supply of the total fraction of lubricating oil entrained in the air flow will also vary directly with engine speed.

If the engine is disposed with its rotorshaft in a horizontal position, the beneficial effect of gravity flow of oil along the rotorshaft would be largely lost. In that case, however, the axial flow of cooling air along the rotorshaft would provide the primary means of lubricating oil movement, assisted by the normal dispersion of oil created by the movement of the rotating internal engine components.

Figure 3:
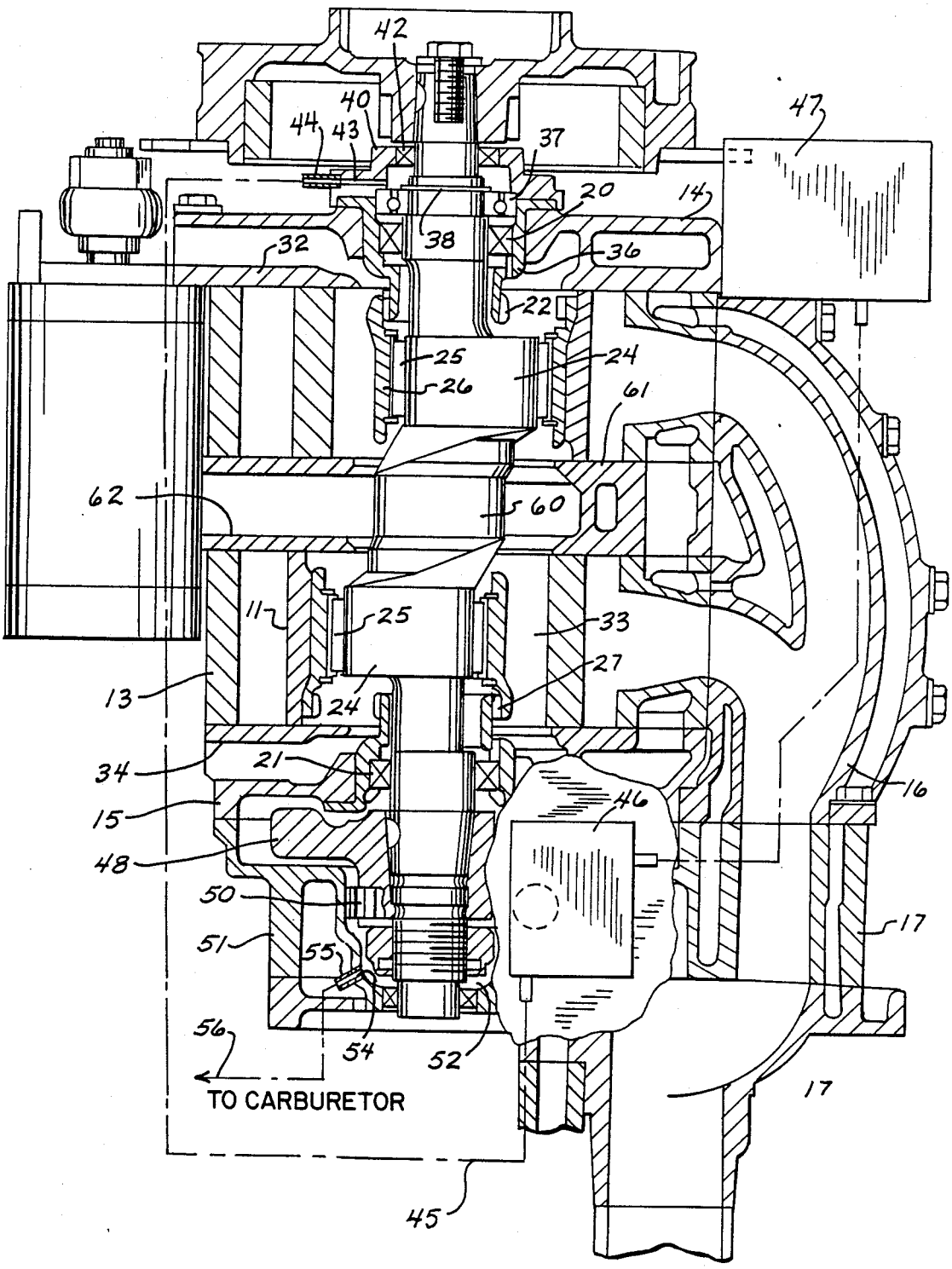
FIG. 3 is a vertical section through a twin rotor engine utilizing the lubrication system of the present invention.

The engine lubrication system described hereinabove may also be used on a twin rotor engine. Referring particularly to FIG. 3, a twin rotor engine is constructed in a manner very similar to the single rotor engine previously described. However, it additionally includes a lengthened rotorshaft 60 adapted to accommodate two rotors 11, and an additional rotor housing 13 for the second rotor. In addition, the upper and lower rotor housings 13 are separated by an intermediate center housing 61 to provide separation of the rotor housings and to provide an additional passage for the flow of cooling air (as well as cooling water, if utilized). In a twin rotor engine, the flow of cooling air may be controlled such that air is taken in via the upper and lower housings 14 and 15, and discharged via the center housing 61. Alternately, the flow of cooling air may be reversed, taking it in via the center housing and discharging it via the upper and lower housings.

If a twin rotor engine is utilized with its rotorshaft disposed vertically, reliance may be placed on gravity as the primary impetus for lubricating oil flow from the upper end of the engine to the lower, as described with respect to the preferred embodiment of the single rotor engine. With the split flow of cooling air, however, one of the split air flows will always be in a direction counter to the axial movement of oil under the influence of gravity. Correspondingly, however, the other split cooling air flow will be in the same direction as the desired gravity flow. In any event, with a vertically oriented rotorshaft, the combined effect will always be a general downward movement of lubricating oil from the oil supply line 45 to the end cap 40 downwardly along the rotorshaft and through the engine block to the oil sump 52 at the lower end. Thus, the lubrication system in a twin rotor engine operates virtually identically with the system for the single rotor engine previously described.

A problem may be encountered, however, if a twin rotor engine is utilized with its rotorshaft horizontally disposed. In such a case, the opposed split flows of cooling air along the rotorshaft may prevent adequate movement of lubricating oil supplied at one end of the shaft to the opposite end. To overcome this problem, lubricating oil may be supplied to both ends of the rotorshaft and caused to move axially along the shaft from both ends toward the center housing 61 to provide full length lubrication. Substantially more lubricating oil would be entrained in the cooling air flows and the oil-laden cooling air is directed from a center cooling air outlet 62 in the center housing 61 to the inlets 57 to the carburetor 28 for each rotor chamber 23. Any tendency for oil to drop out of the cooling air flow and be deposited to form a puddle in a low lying area may be overcome by providing the low lying area with an oil circulation line similar to line 56 in the preferred embodiment. Thus, oil collecting in a puddle can be circulated directly to a carburetor inlet by utilizing the pressure differential, as previously described.

Instead of circulating lubricating oil from the oil sump 52 or other part of the engine to the carburetor inlet or inlets 77, the carburetor may be bypassed and the oil supplied directly into the rotor chamber 23. In this alternate construction, of course, the circulated oil is injected directly into the combustion region of the rotor chamber directly adjacent the air/fuel outlet from the carburetor.

As will be apparent from the foregoing description, the present invention provides a system and directly related method for providing lubricating oil directly to the main rotating components of the engine and then passing that lubricating oil directly into the combustion chamber for further engine lubrication and eventual burning. Further, lubricating oil circulated into the rotor chamber may come either from a main oil sump at one end of the rotorshaft or from oil entrained in the cooling air flow through the engine. In either or both cases, efficient use is made of the lubricating oil supply and there is little or no puddling of oil and the consequent problem of disposal.

Various modes of carrying out the present invention are contemplated as being within the scope of the following claims particularly pointing out and distinctly claiming the subject matter which is regarded as the invention.

I claim:

1. In a rotary internal combustion engine having a rotor housing including a generally central opening defining a rotor chamber, an outer housing member attached to each side of the rotor housing adjacent to the central opening, a rotorshaft carrying a rotor for rotation within the rotor chamber, said rotorshaft extending in opposite directions through the outer housing members and journaled for rotation therein, an improved engine lubrication system comprising:

a source of lubricating oil;

means for transferring oil from the source to one end of the rotorshaft adjacent its journaled connection to one outer housing member;

means for causing the oil to flow from said one end axially along the rotorshaft, through the rotor housing, and out through the other housing member; and, means for directing the oil from said other housing member into the combustion region of the rotor chamber.

2. The invention as set forth in claim 1 wherein said rotorshaft is disposed vertically and the oil is transferred from the source to the upper end of the rotorshaft.

3. The invention as set forth in claim 2 including an upper end cap attached to said one housing member and enclosing the interface between said housing member and the rotorshaft, and wherein the oil is transferred to the interior of said end cap.

4. The invention as set forth in claim 3 wherein said transferring means comprises an engine driven oil pump to receive oil from the source and to supply oil to the interior of said end cap.

5. The invention as set forth in claim 4 including a lower end cap attached to the other housing member and enclosing the interface between said other housing member and the rotorshaft, and wherein said lower end cap defines a sump or receipt of the oil which flows axially along the rotorshaft.

6. The invention as set forth in claim 5 further comprising a fluid connection between the sump and the combustion region of the rotor chamber.

7. In a rotary internal combustion engine having a rotor housing including a generally central opening defining a rotor chamber, an outer housing member attached to each side of the rotor housing adjacent to the central opening, a rotorshaft carrying a rotor for rotation within the rotor chamber, said rotorshaft extending in opposite directions through the outer housing members and journaled for rotation therein, a method for lubricating the engine comprising the steps of:

(1) providing a source of lubricating oil;

(2) transferring oil from the source to one end of the rotorshaft adjacent its journaled connection to one outer housing member;

(3) causing the oil to flow from said one end axially along the rotorshaft, through the rotor housing, and into the other housing member; and, (4) directing the oil from the other housing member into the combustion region of the rotor chamber.

8. The method as set forth in claim 7 wherein the rotorshaft is disposed vertically and the transferring step comprises transferring oil to the upper end of the rotorshaft.

9. The method as set forth in claim 8 wherein the oil is caused to flow vertically downwardly along the rotorshaft by gravity.

10. The method as set forth in claim 7 wherein the step of directing the oil into the combustion region comprises drawing the oil into the combustion chamber with the combustion air flow.

* * * * *